United States Patent [19]

Oster et al.

[11] Patent Number: 4,951,846

[45] Date of Patent: Aug. 28, 1990

[54] HOT MELT APPLICATOR WITH ANTI-DRIP MECHANISM

[75] Inventors: Craig D. Oster, Oakdale; Gerald W. Quinn, St. Paul; Rodney J. Wilson, Forest Lake, all of Minn.

[73] Assignee: Minnesota Mining and Manufacturing Company, St. Paul, Minn.

[21] Appl. No.: 305,846

[22] Filed: Feb. 2, 1989

[51] Int. Cl.[5] ..... B67D 5/00

[52] U.S. Cl. ..... 222/146.5; 222/391; 74/128; 74/141.5; 226/127; 226/165

[58] Field of Search ..... 222/108, 109, 146.2, 222/146.5, 391; 74/128, 141.5, 470; 226/127, 162–165, 166, 167

[56] References Cited

U.S. PATENT DOCUMENTS

| | | | |
|---|---|---|---|
| 3,281,576 | 10/1966 | Cooper et al. | 219/421 |
| 3,707,258 | 12/1972 | Schlitt | 228/52 |
| 4,032,046 | 6/1977 | Elliott et al. | 222/146.5 |
| 4,289,257 | 9/1981 | Herb et al. | 222/146.5 |
| 4,378,076 | 3/1983 | Stirnweiss | 222/146.5 |
| 4,379,516 | 4/1983 | Barlogis | 222/146 HE |
| 4,523,705 | 6/1985 | Becanger et al. | 222/146.5 |
| 4,552,287 | 11/1985 | Dziki | 222/146.5 |
| 4,621,748 | 11/1986 | Dziki | 222/146.5 |
| 4,637,745 | 1/1987 | Speisebecher et al. | 401/1 |
| 4,639,155 | 1/1987 | Schuster et al. | 401/1 |
| 4,658,991 | 4/1987 | Dziki | 222/146.5 |
| 4,660,743 | 4/1987 | Speisebecher et al. | 222/146.5 |
| 4,774,123 | 9/1988 | Dziki | 428/156 |
| 4,776,490 | 10/1988 | Wingert | 222/146.5 |
| 4,781,482 | 11/1988 | Ursprung | 401/1 |
| 4,815,636 | 3/1989 | Stede et al. | 222/391 |

FOREIGN PATENT DOCUMENTS

| | | | |
|---|---|---|---|
| 0216716 | 4/1987 | European Pat. Off. | 222/146.5 |

*Primary Examiner*—Kevin P. Shaver
*Assistant Examiner*—Boris Miler
*Attorney, Agent, or Firm*—Donald M. Sell; Walter N. Kirn; James D. Christoff

[57] ABSTRACT

A hot melt applicator has a feeding mechanism for advancing a block of solid material toward a melting chamber, and the feeding mechanism includes a retraction device for shifting the block a slight distance in a rearward direction to a retracted position subsequent to the dispensing operation. The feeding mechanism has a release device for enabling the block to float freely after moving to the retracted position in order to provide additional room for molten material in the melting chamber upon thermal expansion of the material.

5 Claims, 5 Drawing Sheets

Fig. 9
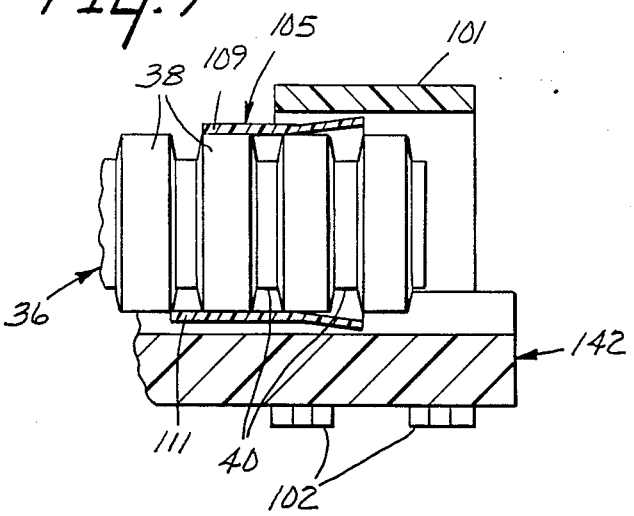
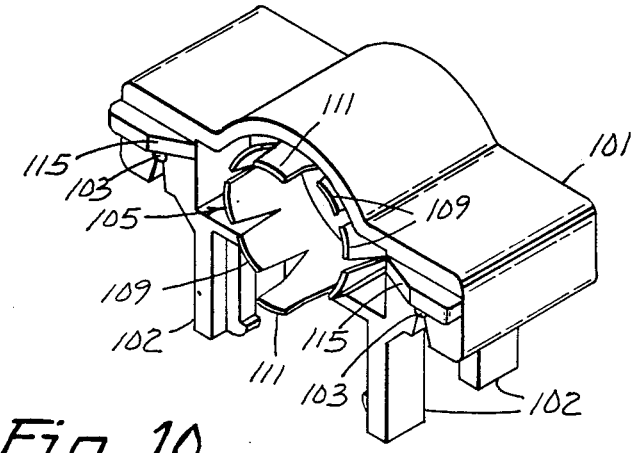
Fig. 10

HOT MELT APPLICATOR WITH ANTI-DRIP MECHANISM

BACKGROUND OF THE INVENTION

1. Field of the Invention

This invention relates to a mechanism for feeding solid blocks of hot melt material toward a melting chamber of a hot melt applicator.

2. Description of the Related Art

Hand-held hot melt applicators as well as stationary hot melt applicators have a melting chamber that is adapted to receive and melt a forward end portion of an elongated, solid block of hot applied adhesive, sealant or similar material. The melting chamber has an outlet which dispenses molten material to a work site as additional portions of the block are fed into the melting chamber.

During use of many types of conventional hand-held hot melt adhesive applicators, thumb pressure is applied against the trailing end of the block of adhesive to advance the block toward the melting chamber while the fingers of the same hand grasp a handle of the applicator. In recent years, however, applicators having a feeding mechanism for guiding the blocks of solid adhesive toward the melting chamber have become available. As one example, the applicator described in U.S. Pat. No. 4,621,748 has a feeding mechanism with a drive member that, when depressed by an operator's thumb, moves a drive rack toward a position interleaved with a series of teeth formed in the block of adhesive in order to engage and shift the block forward toward the melting chamber.

A common problem of conventional hot melt adhesive applicators is the tendency for molten adhesive to drip from the nozzle for some time after the operator has relieved the forward pressure on the block. In such situations, the operator must move the applicator to prevent excess adhesive from reaching the work site, and position the nozzle of the applicator over a drip pan to prevent damage to the work area. Even more serious, however, is the potential for the molten adhesive to burn the user while dripping from the nozzle after the intended dispensing operation.

One solution proposed to overcome the problem of post-dispensing adhesive dripping is the provision of a check valve placed within the nozzle of the applicator. However, it is difficult to select a satisfactory, reliable spring for such a check valve because an overly stiff spring increases back pressure and hinders precise hand control of the dispensing operation while the block is fed into the melting chamber, while an overly weak spring may not close the valve in all instances.

Certain hot melt applicators have a feeding mechanism that is operable to retract remaining solid portions of the adhesive block after a dispensing operation. As one example, some stationary hot melt applicators have a feeding mechanism with a pair of fixed axis drive rollers which continuously engage and indent one side of the block. The drive rollers are connected to a reversible motor that initially moves the block toward the melting chamber to dispense molten adhesive, and then away from the melting chamber to suck back molten adhesive from the nozzle tip and provide room in the chamber for subsequent thermal expansion of a portion of the adhesive which remains in the chamber.

As another example, U.S. Pat. No. 4,379,516 describes a hand-held applicator with a clamping member that releasably grips a block of adhesive as the block is advanced, and the member is molded with a pair of resilient wings which retract the member along with the block at the end of a dispensing operation. Rearward movement of the clamping member shown in U.S. Pat. No. 4,379,516 ceases when the wings push the member into a position of contact with a rear wall of the applicator.

However, the distance that the afore-mentioned devices retract the block at the end of a dispensing operation must be carefully selected. If the retraction distance is too small, insufficient space for subsequent thermal expansion may result and the pressure of the expanding adhesive may force molten adhesive from the nozzle. On the other hand, if the retraction distance is too large, the forward end of the block may cool excessively and additional time or energy will be necessary before molten adhesive can replace the voids in the heat block and the dispensing operation can resume Moreover, if the retraction distance is too large, oxidation of the adhesive may be accelerated and an undue amount of air bubbles may be present in the extruded adhesive.

SUMMARY OF THE INVENTION

The present invention concerns an applicator for dispensing molten material from an elongated block of solid thermoplastic material, and includes a frame and a melting chamber which is connected to the frame and which is adapted to receive and melt a portion of a block of solid material. A feeding mechanism is coupled to the frame for selectively advancing the block toward the melting chamber, and the feeding mechanism includes a retraction device for moving the block away from the melting chamber to a retracted position after the portion of the block has melted. The feeding mechanism further includes a release device for enabling essentially free-floating, longitudinal movement of the block during thermal expansion of material within the melting chamber after the block has moved to the retracted position.

The release device substantially prevents the build-up of excessive pressures of molten material within the melting chamber subsequent to the dispensing operation since thermal expansion of the forward end of the retracted block within the melting chamber causes the block to push itself rearwardly as necessary to compensate for the increased volume of the material Consequently, the molten material does not unduly bear against the check valve in the nozzle of the applicator and post-dispensing dripping of molten material from the nozzle is largely avoided regardless of the distance that the solid block is initially retracted by the retraction device

BRIEF DESCRIPTION OF THE DRAWINGS

FIG. 9 is a fragmentary, enlarged, side cross-sectional view of a portion of the feeding mechanism shown in FIG. 7; and FIG. 10 is an enlarged front, top and side perspective view of part of the feeding mechanism illustrated in FIG. 7.

DESCRIPTION OF THE PREFERRED EMBODIMENTS

Figure 1:
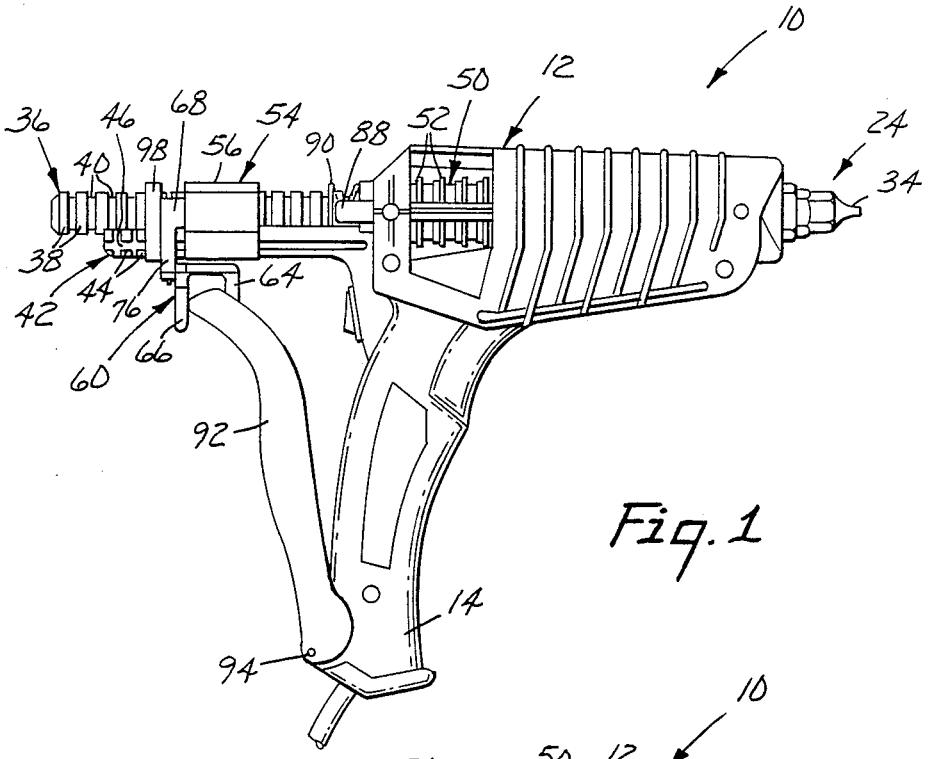
FIG. 1 is a side elevational view of an applicator according to the present invention.
Figure 1A:
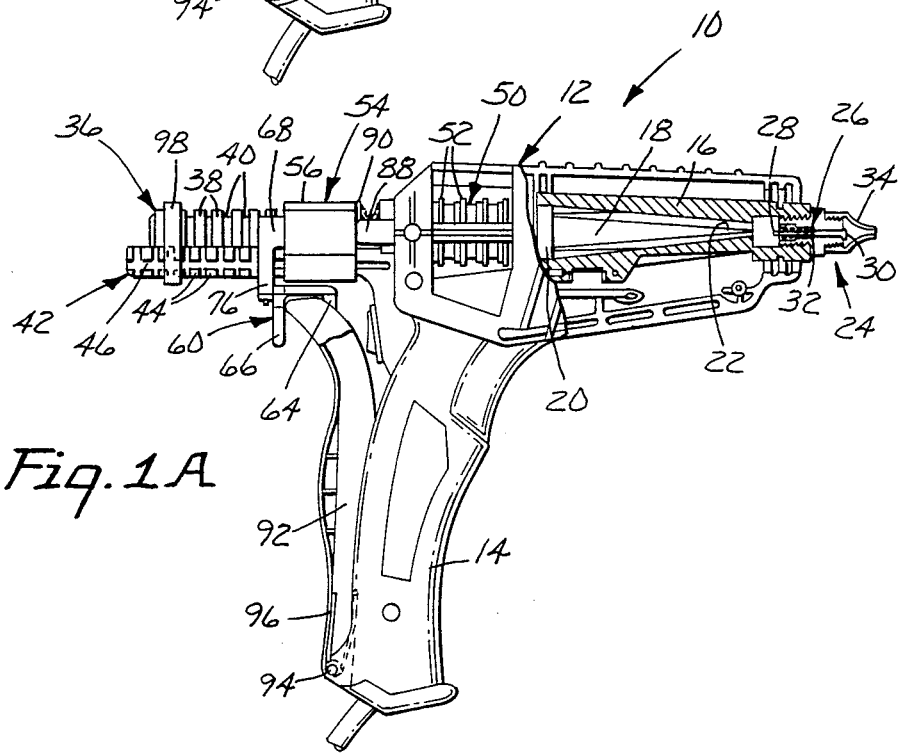
FIG. 1*a* is a side elevational view of the applicator shown in FIG. 1 except that an actuator of the applicator has been depressed to advance a block of solid adhesive toward a melting chamber, and wherein a portion of the applicator is broken away in section.

An applicator 10 for dispensing molten thermoplastic material is shown in FIGS. 1 and 1*a* includes a molded frame 12 that presents a depending handle 14 and an upper portion which encases a heating block 16 (FIG. 1*a*). The heating block 16 has an internal melting chamber 18 in the shape of a truncated cone, and the chamber 18 has an inlet 20 on one end and tapers at its opposite end to an outlet 22 that leads to an internal passageway of an adjacent nozzle assembly 24.

As illustrated in FIG. 1*a*, the nozzle assembly 24 has an internal check valve 26 which includes a stem 28 having an enlarged head 30. A compression spring 32 is received around the stem 28 remote from the head 30 and bears against an aperatured plate connected to the stem 28 to bias the latter to the left viewing FIG. 1*a* toward a position to bring the head 30 in sealing contact with internal walls of a nozzle tip 34. During a dispensing operation, pressure of molten thermoplastic adhesive within the melting chamber urges the head 30 toward an open position to enable the molten adhesive to flow from the melting chamber 18, through the outlet 22, around the stem 28 and the head 30 and out a small opening formed in the end of the nozzle tip 34 to the work site.

The heating block 16 carries a pair of electrical resistance heating elements (not shown) that extend in a direction slightly inclined relative to the central axis of the melting chamber 18. Thus, as a forward end portion of a block of solid thermoplastic adhesive 36 is moved through the inlet 20 and into the melting chamber 18, the forward end portion melts and the molten adhesive is forced toward the outlet 22 as additional portions of the solid adhesive block 36 are directed into the chamber 18.

The elongated block of adhesive 36 is formed with a series of coaxial cylindrical tooth portions 38, each of which is spaced apart from adjacent cylindrical portions 38 by square portions 40 which have uniform diagonal dimensions about equal to the diametrical dimensions of the cylindrical portions 38. The adhesive block 36 is essentially similar to the block of adhesive described in U.S. Pat. No. 4,774,123, issued Sept. 27, 1988.

The frame 12 includes a rearwardly extending rack 42 that is shown in FIGS. 1–2 and 5–6. Opposite vertical sides of the rack 42 are formed with a series of upright, spaced apart teeth 44 along with a horizontally extending channel 46 that can be best observed by reference to FIG. 1*a*. In addition, the rack has an open bottom, trapezoidal shaped channel 48 that extends in a horizontal direction parallel to the two side channels 46.

Figure 2:
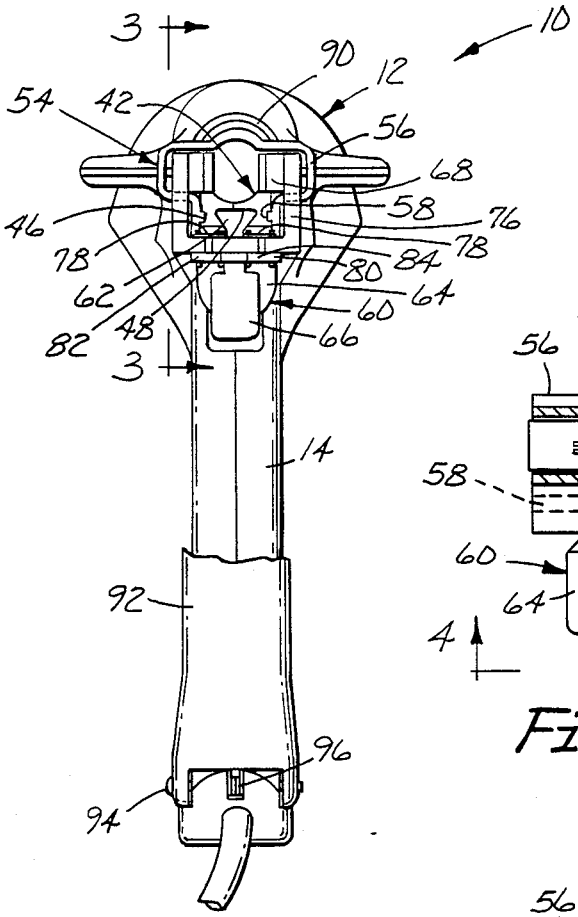
FIG. 2 is an enlarged, end elevational view of the applicator shown in FIG. 1 except that the block of adhesive has been removed and the actuator is depicted in fragmentary form.

As can be seen in FIG. 2, the top of the rack 42 has a longitudinally extending, rounded trough which supports the adhesive block 36 as the latter moves through a cylindrical sleeve 50 (FIGS. 1 and 1*a*) and toward the inlet 20 of the melting chamber The sleeve 50 carries a number of spaced apart, ring-shaped cooling flanges 52 to substantially prevent melting of portions of the adhesive block 36 that are adjacent the inlet 20 but outside of the melting chamber 18. The sleeve 50 also functions to align the adhesive block 36 during its travel through the inlet 20 and into the melting chamber 18.

A feeding mechanism 54 is movably coupled to the rack 42 of the frame 12 for selectively advancing the adhesive block 36 toward the melting chamber 18. The feeding mechanism 54 includes a slide 56 which has a generally inverted U-shaped configuration, and a domed top portion of the slide 56 extends around the top of the adhesive block 36. A pair of lower, opposed, depending legs of the slide 56 each include a horizontally extending guide 58 which slides along one of the side channels 46 of the rack 42.

The feeding mechanism 54 also includes a control body 60 that has an upper, trapezoidal-shaped key 62 that is complemental in cross-sectional configuration to the transverse shape of the trapezoidal channel 48 as can be appreciated by reference to FIG. 2. The key 62 extends in a horizontal direction parallel to the longitudinal axis of the rack 42, and is slidable along the length of the channel 48. Below the key 62, the control body 60 has a generally inverted U-shaped configuration (see, e.g., FIG. 3) that is presented by a front depending tab 64 and a rear depending tab 66 spaced behind the tab 64 in a direction along the length of rack 42.

The control body 60 is movably connected to the slide 56 by a pair of arms 68, 68 which are shown in FIGS. 2–6. The arms 68 are each pivotally connected to opposed, U-shaped portions of the slide 56 by means of a vertical pin 70 which extends through the coil of a wire torsion spring 72 that bears against adjacent portions of the slide 56 and the respective arms 68.

Figure 5:
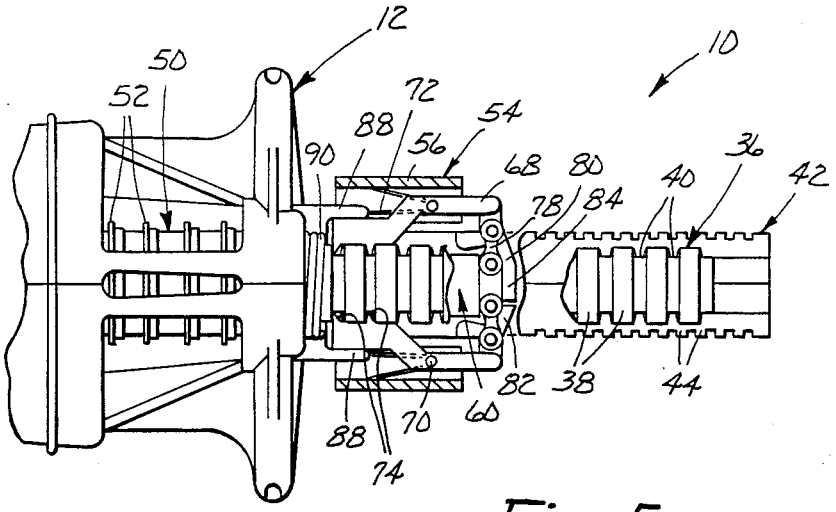
FIG. 5 is an enlarged plan view of a portion of the applicator shown in FIG. 1*a* with the retraction mechanism illustrated in section to show the gripping arms in a closed position for advancing the block of adhesive toward the melting chamber.
Figure 6:
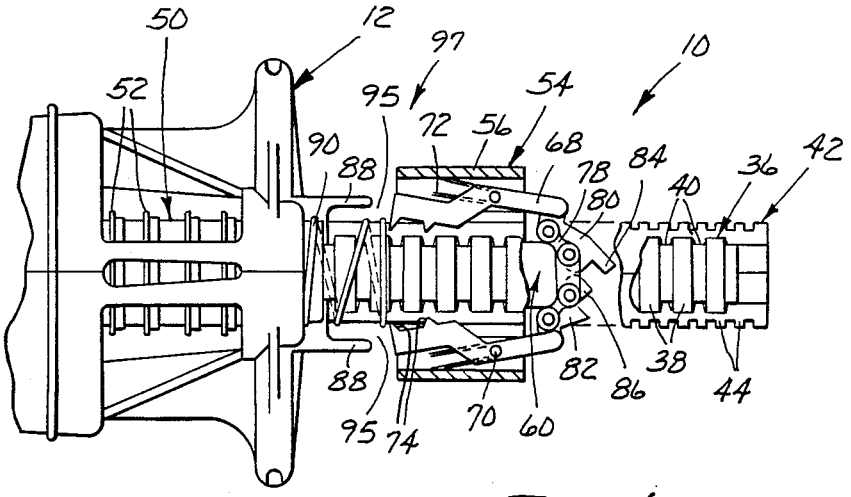
FIG. 6 is a view somewhat similar to FIG. 5 except that the feeding mechanism has been moved away from the melting chamber and the arms have opened to release their grip from the block of adhesive.

Each of the arms 68 has a front portion with a pair of spaced apart, upright teeth 74 (FIGS. 5 and 6) that are complemental in shape to the recesses between adjacent tooth portions 38 of the adhesive block 36. The arms 68 are swingable about pins 70 from a closed position that is illustrated in FIG. 5 with the teeth 74 in firm, gripping contact with the adhesive block 36, and to an open position as is shown in FIG. 6 wherein the arms 68 have disengaged and thus released their grip from the block 36. The springs 72 bias the arms 68 to the closed position.

Figure 3:
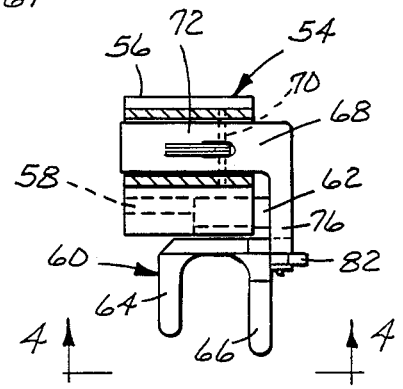
FIG. 3 is an enlarged, side cross-sectional view of a feeding mechanism alone of the applicator shown in FIGS. 1–3 and taken along lines 3—3 of FIG. 2.
Figure 4:
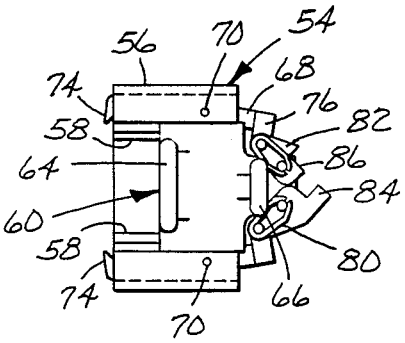
FIG. 4 is a bottom view of the feeding mechanism taken along lines 4—4 of FIG. 3 except that a control body of the mechanism has been shifted to open a pair of gripping arms.

Referring now to FIGS. 2, 3 and 5, the arms 68 each have a depending, L-shaped leg 76 with a lowermost, inwardly extending portion that is pivotally connected to an upper link 78, 78 and a corresponding lower link 80, 82. In turn, links 78, 80, 82 are pivotally coupled to a rearwardly extending flange portion of the control body 60. Movement of the control body 60 in rearward direction relative to the slide 56 causes the links 78, 80, 82 to pull inwardly on the legs 76 and thereby pivot the respective arms 68 about pins 70 and cause the arms 68 to open as shown in FIGS. 4 and 6 to disengage the adhesive block 36. On the other hand, movement of the control body 60 in a forward direction relative to the slide 56 moves the links 70, 80, 82 to aligned positions transverse to the length of the rack 42 and thus spreads the legs 76 apart to cause the arms 68 to swing in an opposite direction about pins 70 to a closed position wherein the teeth 74 firmly grip the adhesive block 36 in the manner shown in FIG. 5.

The link 80 includes a projection 84 that is received on a shoulder 86 (FIGS. 4 and 6) formed in the lower link 82 when the control body 60 is urged in a forward direction (toward the melting chamber 18) and the arms 68 have moved to their closed position as shown in FIG. 5. The projection 84 and shoulder 86 function as a stop to prevent the arms 68 from moving past their closed position when the control body 60 is moved forwardly so that the arms 68 do not toggle past their closed position and begin to open.

The feeding mechanism 54 includes a pair of upright, parallel walls 88 (FIGS. 1–1*a* and 5–6) that are integrally connected to the frame 12 and are spaced above and along opposite sides of the rack 42. When a force is directed in a forward direction against the front tab 64 of the control body 60, the arms 68 move toward their closed position to grip the block 36 and move the block 36 from an initial position (FIG. 1) and toward the melting chamber 18. As shown in FIG. 5, an external, forward, vertical side section of each arm 68 moves alongside an inner surface of the corresponding wall 88 as the control body 60 and the slide 56 approach the melting chamber 18, and the walls 88 function to retain the arms 68 in gripping contact with the adhesive block 36 so long as the front ends of the arms 68 are forward of the rear end of the walls 88.

The feeding mechanism 54 includes a retraction device, that, in turn, includes a first coil spring 90 which is connected to the frame 12 between the walls 88 and which circumscribes the adhesive block 36. The spring 90 also bears against the front ends of the arms 68 once the block 36 has been moved by the feeding mechanism 54 to a melting position shown in FIG. 5. After forward pressure is relieved from the front tab 64 of the control body 60, the spring 90 urges the arms 68 rearwardly which in turn also causes the slide 56 and the adhesive block 36 to move rearwardly until the adhesive block 36 reaches a retracted position which is illustrated in FIG. 6.

Referring again to FIGS. 1–2, an elongated actuator 92 is movably connected at its lower end to the handle 14 of frame 12 by horizontal pivot pin 94. The pin 94 extends through a coil of a torsion spring 96 (FIGS. 1*a*–2) that urges the actuator 92 in a counter-clockwise arc viewing FIGS. 1–1*a*. The spring constant of spring 96 is less than the spring constant of the spring 90.

An upper end of the actuator 92 is received in the space between the front tab 64 and the rear tab 66 of the control body 60. During typical use, the operator grasps the handle 14 with one hand and squeezes the actuator 92 toward the handle 14 with the same hand in order to advance the adhesive block 36 from its initial position to its melting position to dispense molten adhesive from the nozzle tip 34. After hand pressure on the actuator 92 is released, the second spring 96 causes the top of the actuator 92 to bear against the rear tab 66 and both of the springs 90, 96 move the block 36 rearwardly to its retracted position. The distance that the block 36 moves from its melting position (with the actuator 92 fully depressed) to its retracted position is approximately equal to the horizontal length of the walls 88.

As soon as the front ends of the arms 68 have moved rearward of the rear end of the walls 88, the arms 68 open by virtue of the rearward pressure on the rear tab 66 exerted by the actuator 92 and the second spring 96. The second spring 96 along with a clearance space 95 (FIG. 6) behind the arms 68 when rearward of the walls 88 comprise a release device 97 for releasing the grip of the arms 68 from the block 36 once the latter reaches its initial retracted position The second spring 96 continues to urge the control body 60 in a rearward direction and thus enables the body 60 and the slide 56 to move relative to the adhesive block 36 and back toward the position illustrated in FIG. 1.

As soon as the release device 97 releases its grip from the block 36, the block 36 may freely move as necessary in a rearward, longitudinal direction to compensate for further thermal expansion of the heated forward end of the block 36 and molten material within the chamber 18. Essentially, the release device 97 enables the block 36 to free-float and thereby move as necessary solely as a result of thermal expansion of the heated material.

During the next dispensing operation, the teeth 74 of the arms 68 grasp the adhesive block 36 at a location which is spaced rearward of the location where the teeth 74 engaged the block 36 during the previous dispensing operation. In this manner, the teeth 74 move in ratchet-like fashion relative to the block 36 so that after a number of dispensing operations the block 36 has moved a substantial distance even though the stroke of the top of the actuator 92 during each individual dispensing operation is significantly smaller.

A resilient, inverted U clip 98 is releasably coupled to the rack 42 in any one of a number of positions along the length of the rack 42. The clip 98, which is shown in FIGS. 1, la but removed from FIGS. 2, 5 and 6, has inner wall portions (not shown) that are received in the upright channels between adjacent teeth 44, and the clip 98 also has inwardly extending tabs that extend around a portion of the bottom of the rack 42 to hold the clip 98 in its selected position. The clip 98 functions as a stop for rearward movement of the slide 56 and the control body 60, and thus provides a selective limit for the length of the stroke of the actuator 92 which determines the quantity of dispensed material during any one full stroke. In addition, the movable clip 98 permits the operator to adjust the stroke to match the size and comfort of his or her hand.

An applicator 110 according to a currently preferred embodiment of the invention is depicted in FIGS. 7–10 and includes a frame 112, a melting chamber (not shown) similar to the melting chamber 18 shown in FIG. 1*a* as well as a feeding mechanism 154 having a slide 156, control body (not shown) and arms 168 substantially identical to the corresponding parts of the feeding mechanism 54 described hereinabove. In this form of the invention, however, a housing 101 is located rearward of the feeding mechanism 154 and has four depending legs 102 (FIGS. 9 and 10) that snap in place between teeth 144 of rack 142 to securely hold the housing 101. In somewhat similar fashion to the clip 98 described earlier, the housing 101 may be positioned at any one of a number of locations along the length of the rack 142 and functions as a stop for rearward movement of slide 156. The housing also provides a selective limit for the length of the stroke of the slide 156.

The housing 101 has a generally inverted U-shaped configuration and carries two pins 103 which extend parallel to the rack 142. A generally cylindrical sleeve 105, made of synthetic resinous material, is integrally molded with a pair of elongated wings 107 which extend away from each other, and each wing 107 has a hole through which a respective pin 103 extends. Consequently, the sleeve 105, guided by pins 103, is movable relative to the housing 101 in directions parallel to the length of the rack 142 either toward or away from the melting chamber of the applicator 110.

The cylindrical central portion of the sleeve 105 is formed with a number of resilient, forwardly extending short portions or tabs 109 as well as two somewhat longer tabs 111. The tabs 109, 111 are biased inwardly toward the central axis of the adhesive block 36 and provide a limited amount of resistance to movement of the block 36 relative to the sleeve 105 as explained in more detail below.

Figure 7:
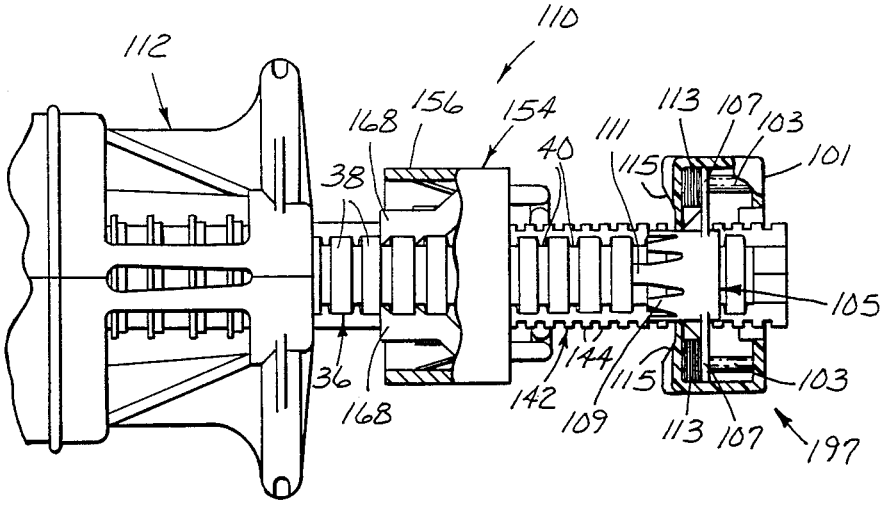
FIGS. 7 and 8 are views somewhat similar to FIGS. 5 and 6 respectively except that a feeding mechanism constructed in accordance with another embodiment of the invention is shown.

In the use of the applicator 110, an actuator similar to actuator 92 is depressed to close the arms 168 of the feeding mechanism 154 and advance the slide 156 with the block 36 toward the melting chamber as shown in FIG. 7. Meanwhile, the tabs 109, 111 engage the block 36 with enough frictional force to cause the sleeve 105 to move forward toward the melting chamber with forward movement of the block 36 and compress spring means compressing a pair of springs 113 which are received around the pins 103 between the wings 107 and the housing 101.

Once the springs 113 are fully compressed and the sleeve 105 has reached its extent of possible forward movement relative to the housing 101, continued forward pressure of the slide 156 on the block 36 overcomes the frictional force presented by the tabs 109, 111, enabling the springs 113 to shift the sleeve 105 relative to the block 36 in a rearward direction. The tabs 109, 111, however, are molded with an inherent, resilient, radially inward bias and thus grab the next rearward cylindrical portion 38 of the block 36, thereby causing the sleeve 105 to again move forwardly with further advancement of the block 36 toward the melting chamber.

The longer tabs 111 are of a length relative to the shorter tabs 109 such that the sleeve 105 retracts only one-half of the distance between adjacent cylindrical portions 38 whenever the sleeve 105 moves rearwardly. Otherwise, elimination of the longer tabs 111 would cause the sleeve 105 to retract essentially the full distance between adjacent cylindrical portions 38 as the short tabs 109 jump from one portion 38 to the next.

Figure 8:
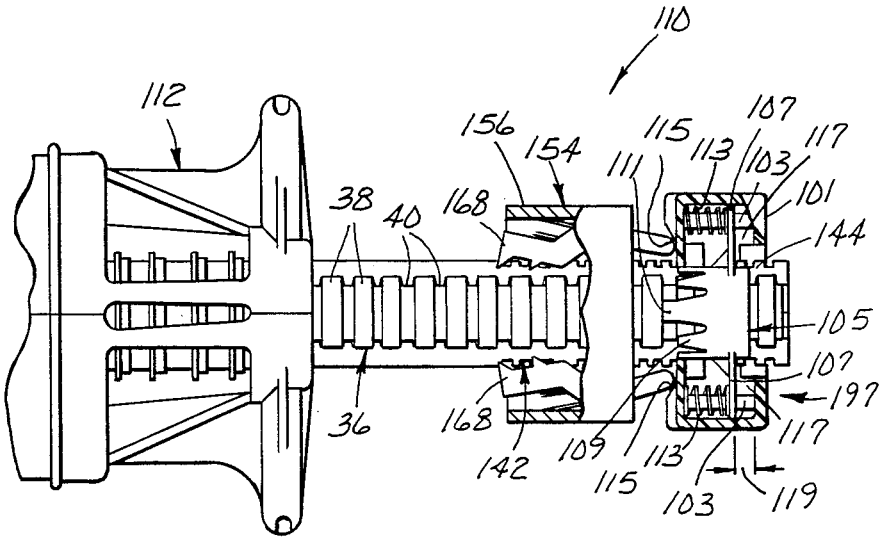

Once forward pressure on the actuator is released, the arms 168 immediately open and disengage the block 36 due to a force exerted on the control body by a spring similar to spring 96. The slide 156 is then moved to the position shown in FIG. 8. Since the tabs 109, 111 are in gripping engagement with the block 36, the compressed springs 113 shift the sleeve 105 and cause the sleeve 105 to move the block 36 rearwardly to the retracted position shown in FIG. 8. Once the slide 156 is next to the stationary housing 101, a trailing end of each arm 168 comes into contact with a respective, inclined wall 115 of the housing 101 and the walls 115 thereafter insure that the arms 168 stay in their open position as shown in FIG. 8 until the next time that the actuator is depressed.

As soon as the block 36 has been retracted, the block 36 is essentially free-floating and may move further in a rearward direction as its forward end expands within the melting chamber over a period of time. The springs 113 are shown in FIG. 8 in their fully extended normal orientation, and the wings 107 may move rearwardly along the pins 103 within the spaces designated 117 (FIG. 8) of the housing 101 as may be necessary to compensate for thermal expansion of the block 36. The possible length of free-floating movement of the wings 107 in space 117 is equivalent to the distance 119 shown in FIG. 8 between the rear surfaces of the wings 107 and the facing wall of a rear portion of the housing 101.

A release device 197 of the feeding mechanism 154 includes the aforementioned spring similar to spring 96 along with the clearance spaces 117, and is somewhat similar to the release device 97 in that both devices 97, 197 permit free movement of the block 36 only after the latter has been automatically retracted. By comparison, the arms 68 of the feeding mechanism 54 are operable to retract the block 36, whereas the sleeve 105 and springs 113 of the feeding mechanism 154 function to retract the block 36. In both of the described embodiments of the invention, however, the feeding mechanisms 54, 154 break loose the block 36 from its dispensing or melting position as the block 36 is retracted in order to facilitate the free-floating capability of the block 36 once released.

We claim:

1. An applicator for dispensing molten material from an elongated block of solid material comprising:

a frame;

a melting chamber connected to said frame and adapted to receive and melt a portion of an elongated block of solid material;

a feeding mechanism coupled to said frame for selectively advancing said block toward said melting chamber; said feeding mechanism including a retraction device for moving said block away from said melting chamber to a retracted position after said portion of said block has melted, said feeding mechanism including a release device for enabling essentially free-floating longitudinal movement of said block during thermal expansion of material within the melting chamber after said block has moved to said retracted position, wherein said feeding mechanism is operable to advance said block from an initial position and to a melting position at least partially within said melting chamber, and wherein said retracted position is located between said melting position and said initial position, wherein said release device includes a sleeve having a resilient portion for frictional contact with said block such that said sleeve is movable with said block as said block is advanced a certain distance and such that said block is also movable relative to said sleeve as said block continues to be advanced past said certain distance, and wherein said release device includes spring means for urging said sleeve and said block therewith in a rearwardly direction, said sleeve being essentially free-floating together with said block for movement relative to said frame after said block has moved to said retracted position.

2. The applicator of claim 1, wherein said release device includes a housing carrying said sleeve and said spring means, said housing being movable to any one of an umber of fixed locations on said frame in directions toward or away from said melting chamber.

3. The applicator of claim 1, wherein said resilient portion comprises a tab biased toward said block for frictional contact with said block.

4. The applicator of claim 3, wherein said sleeve has a generally cylindrical configuration.

5. The applicator of claim 1, wherein said release device includes at least one wall, and wherein said feeding mechanism includes at least one arm movable toward and away from a location in contact with said block, and wherein said at least one wall is engagable with said at least one arm for retaining said arm in a location out of contact with said block once said block has been moved to said retracted position.

* * * * *

UNITED STATES PATENT AND TRADEMARK OFFICE

CERTIFICATE OF CORRECTION

PATENT NO. : 4,951,846

DATED : August 28, 1990

INVENTOR(S) : Craig D. Oster et al.

It is certified that error appears in the above-identified patent and that said Letters Patent is hereby corrected as shown below:

Col. 7, line 32, "compressing" should be — comprising —.

Signed and Sealed this

Eleventh Day of August, 1992

*Attest:*

DOUGLAS B. COMER

*Attesting Officer*

*Acting Commissioner of Patents and Trademarks*